US005969732A

United States Patent [19]

Suetsugu

[11] Patent Number: 5,969,732

[45] Date of Patent: Oct. 19, 1999

[54] ELECTROSTATIC INK-JET RECORDING DEVICE WITH CONTROL ELECTRODES FOR SELECTIVELY PREVENTING EJECTION OF TONER

[75] Inventor: Junichi Suetsugu, Tokyo, Japan

[73] Assignee: NEC Corporation, Tokyo, Japan

[21] Appl. No.: 08/671,613

[22] Filed: Jun. 28, 1996

[30] Foreign Application Priority Data

Jun. 29, 1995 [JP] Japan ..... 7-164310

[51] Int. Cl.[6] ..... B41J 2/06

[52] U.S. Cl. ..... 347/55

[58] Field of Search ..... 347/48, 55, 112, 347/141, 151

[56] References Cited

FOREIGN PATENT DOCUMENTS

| | | | |
|---|---|---|---|
| 0 267 782 | 5/1988 | European Pat. Off. . | |
| 56-167466 | 12/1981 | Japan . | |
| 58-82767 | 5/1983 | Japan . | |
| 61-57343 | 3/1986 | Japan . | |
| 2-102054 | 4/1990 | Japan | 347/55 |
| 5-212869 | 8/1993 | Japan . | |
| 2 031 344 | 4/1980 | United Kingdom . | |
| 9311866 | 6/1993 | WIPO . | |

*Primary Examiner*—Benjamin R. Fuller
*Assistant Examiner*—C. Dickens
*Attorney, Agent, or Firm*—Young & Thompson

[57] ABSTRACT

An electrostatic ink-jet recording head (100) with an ink chamber (15) for storing ink containing electrified toner; an ink path (6) leading to the ink chamber; ink ejecting portions (7, 8) provided at the tip of that ink path; electrophoretic electrodes (15, 11, 11') for moving the electrified toner of the ink along the ink path to the ink ejecting portions by electrostatic repulsive force; and a plurality of ejecting electrodes (**2*a*–2*h*) , arranged near the ink ejecting portions, for forming an electric field for providing an ejecting force to the electrified toner. The ejecting electrodes are controlled by ejection control electrodes (3*a*, 3*b*) that form an electric field for preventing electrified toner from being ejected from the ink ejecting portions. The plurality of ejecting electrodes (2*a*–2*h***) are formed along the ink path, and the ejecting electrodes and ejection control electrodes are stacked over a substrate with insulating layers therebetween. This configuration reduces the wiring area of the electrodes in the ink-jet recording head and compresses the size of the head.

20 Claims, 5 Drawing Sheets

ELECTROSTATIC INK-JET RECORDING DEVICE WITH CONTROL ELECTRODES FOR SELECTIVELY PREVENTING EJECTION OF TONER

BACKGROUND OF THE INVENTION

1. Field of the Invention

The present invention relates to an electrostatic ink-jet recording head using electrified toner as ink material, and more particularly to an electrostatic inkjet recording head which performs recording by ejecting electrified toner from the nozzle of the head by the action of an electric field.

2. Description of the Prior Art

An electrostatic ink-jet recording head according to the prior art, disclosed in the Japanese Patent Laid-open No. 61-57343 Published on Mar. 24, 1986 for example, is provided with an ink chamber, having an ink inlet, for temporary storage of ink, an ink path leading to this ink chamber, and nozzles. An ink ejecting hole is provided at the tip of each nozzle. The bottom face of the ink chamber, the ink path and the bottom face of the nozzles are linearly arranged on the same plane to reduce resistance to the ink flow. At the tip of each nozzle is provided an ejection electrode for controlling the ejection of ink, and either the ink chamber or the ink path is equipped with an auxiliary electrode. An opposite electrode is arranged in a position at a prescribed distance from the tip of the nozzle. The ink includes toner electrified, positively for instance, in an insulating ink solvent. The opposite electrode has a potential which can electrically attract the electrified toner.

First, an electric field is formed by supplying a prescribed voltage to the auxiliary electrode. In response to the effect of this electric field, there is witnessed an electrophoretic phenomenon in which electrified toner in the ink solvent moves toward the ejecting hole of the nozzle, resulting in concentration of the electrified toner in the tip portion of the nozzle. As a voltage is applied in this state to the ejection electrode at the tip portion of the nozzle, a strong electric field works on the electrified toner in the tip portion of the nozzle, and the grains of the electrified toner, while being strongly attracted by the opposite electrode, fly from the ejecting hole. If recording paper is arranged on the opposite electrode side then, printing will take place. After the ejection of the electrified toner, in order to make up for any shortage of ink (electrified toner) in the nozzle, a member made of porous material is provided in either the ink chamber or the ink path, so that the porous member can serve to effectively supply ink, consisting of electrified toner, in the ink chamber to the nozzle.

However, production of this electrostatic ink-jet recording head according to the prior art requires the arrangement of a porous member in either the ink chamber or the ink path, resulting in a disadvantageously complex manufacturing process. Moreover, since the ejection electrode and the auxiliary electrode are arranged on the same plane and at a distance from each other to prevent their short-circuiting, the packaging area is correspondingly enlarged, inviting another disadvantage of a greater head size. Furthermore, if the number of nozzles is increased, the wiring area for the signal electrode and the auxiliary electrode will be enlarged, resulting in correspondingly greater dimensions of the ink-jet recording head.

SUMMARY OF THE INVENTION

An object of the present invention is to obviate these disadvantages of the prior art and to provide a smaller electrostatic ink-jet recording head whose manufacturing process is relatively simple.

According to the invention, there is provided an electrostatic ink-jet recording head comprising an ink chamber for storing ink containing electrified toner; an ink path leading to the ink chamber; ink ejecting portions provided at the tip of the ink path; electrophoretic electrodes for shifting the ink of the electrified toner deposited in the ink path to the ink ejecting portions by electrostatic repulsive force; a plurality of ejecting electrodes, arranged near the ink ejecting portions, for forming an electric field for providing ejecting force to the electrified toner contained in the ink deposited in the ink path; and ejection control electrodes. The ejection control electrodes form an electric field for preventing electrified toner from being ejected from the ink ejecting portions. The plurality of ejecting electrodes are formed in the vicinity of the ink ejecting portions along the ink path. The plurality of ejecting electrodes and the ejection control electrodes are stacked over a substrate with insulating layers in-between. This arrangement enables the wiring area for the various electrodes in the ink-jet recording head to be reduced and the head size to be compressed.

According to the invention, for instance, ejecting electrodes are formed over a substrate, a first insulating layer is formed over the ejecting electrodes, and an ejection control electrode is formed on the first insulating layer in a position where it comes over the ejecting electrodes. A second insulating layer is further formed on the ejection control electrode. The ink ejecting portions, comprising path diaphragms and ink ejecting holes, are formed over the ejecting electrodes and ejection control electrode. Thus, what is required is merely to stack one layer over another, which is not a particularly complex manufacturing process. The sequence of stacking the ejecting electrodes and the ejection control electrode may be reversed.

The electrophoretic electrodes comprise first and second electrophoretic electrodes sandwiching the ink path and a third electrophoretic electrode formed on the interface between the ink chamber and the ink path. Each electrophoretic electrode should desirably be supplied with a voltage of the same polarity as that in which the toner is electrified. When a prescribed voltage is applied to the electrophoretic electrodes, the electrified toner in the ink path is shifted to the ink ejecting portions by electrophoresis. The use of the electrophoretic electrodes sandwiching the ink path dispenses with the porous member, which the prior art requires, within the ink path, and the absence of any obstacle, such as the porous member, facilitates high-speed toner supply, resulting in high-speed and high-quality printing.

The partial presence of the electrophoretic electrodes within the ink path forcibly discharges surplus counter ions (having a polarity reverse to the electrified toner) generated in the vicinities of the ejecting electrodes after the ejection of the electrified toner from the ink ejecting portions.

A plurality of ejecting electrodes may as well be formed linearly in parallel to one another in the shifting direction of the electrified toner in the ink path. This arrangement would make possible dense wiring of the ejecting electrodes, resulting in additional contributions to improvement of the printing resolution and size reduction of the recording head.

Alternatively, the ejection control electrodes may as well be formed in a direction orthogonal to the plurality of ejecting electrodes. This arrangement enables one of the ejection control electrodes to collectively inhibit the ejecting actions by the plurality of ejecting electrodes, and thereby to reduce the number of ejection control electrodes. The reduced number of ejection control electrodes provides the additional benefit of simplifying the configuration of the drive circuit for the recording head.

Thus, the present invention can provide an unprecedentedly excellent electrostatic ink-jet recording head.

DETAILED DESCRIPTION OF THE PREFERRED EMBODIMENT

Figure 1:
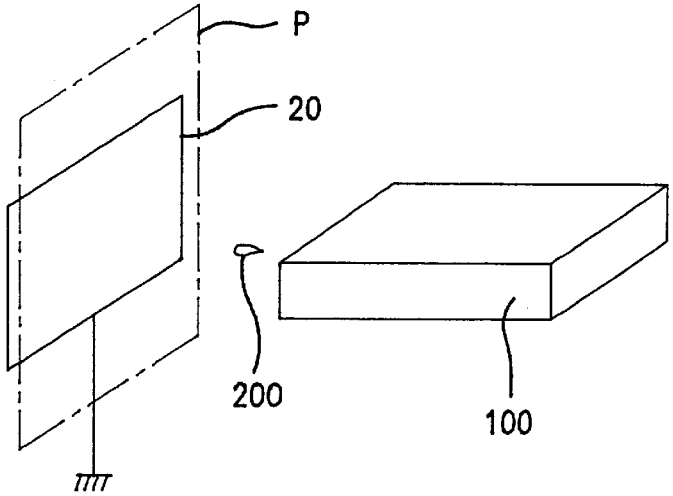
FIG. 1 shows a schematic perspective view of a recording apparatus using an electrostatic ink-head recording head according to the invention.

In FIG. 1, an electrostatic ink-jet recording head 100 is arranged facing an opposite electrode 20, which is provided on its ink ejecting side at a prescribed distance. Recording paper P is arranged between the opposite electrode 20 and the ink ejecting portions of the electrostatic ink-jet recording heat 100, and fed for printing. Ink in the electrostatic ink-jet recording head 100 contains toner electrified in a prescribed (e.g. positive) polarity. The opposite electrode 20 is intended to effect an electric field between itself and the electrostatic ink-jet recording head 100. When the electrostatic ink-jet recording head 100 is driven at a high voltage, the opposite electrode 20 is at a low potential. In FIG. 1, the opposite electrode 20 is grounded.

When the recording head 100 is driven, electrified toner in the ink shifts within the recording head 100 toward the ink ejecting portions, and then ejected from the ink ejecting portions as ink drops 200 by the action of the electric field between the recording head 100 and the opposite electrode 20, and recorded on the recording paper P.

Figure 2:
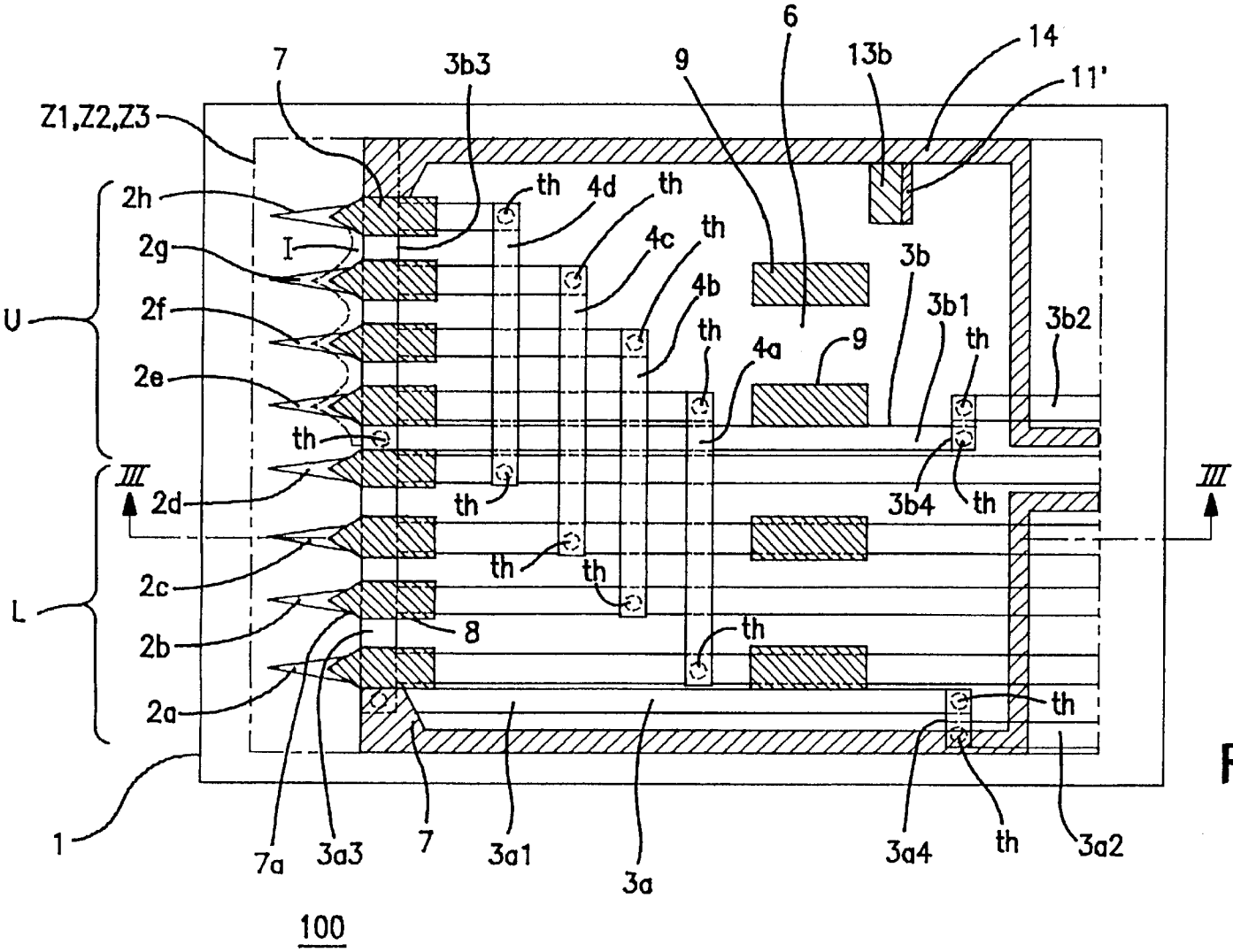
FIG. 2 shows a partially abridged plan of an electrostatic ink-jet recording head, which is a preferred embodiment of the invention.
Figure 3:
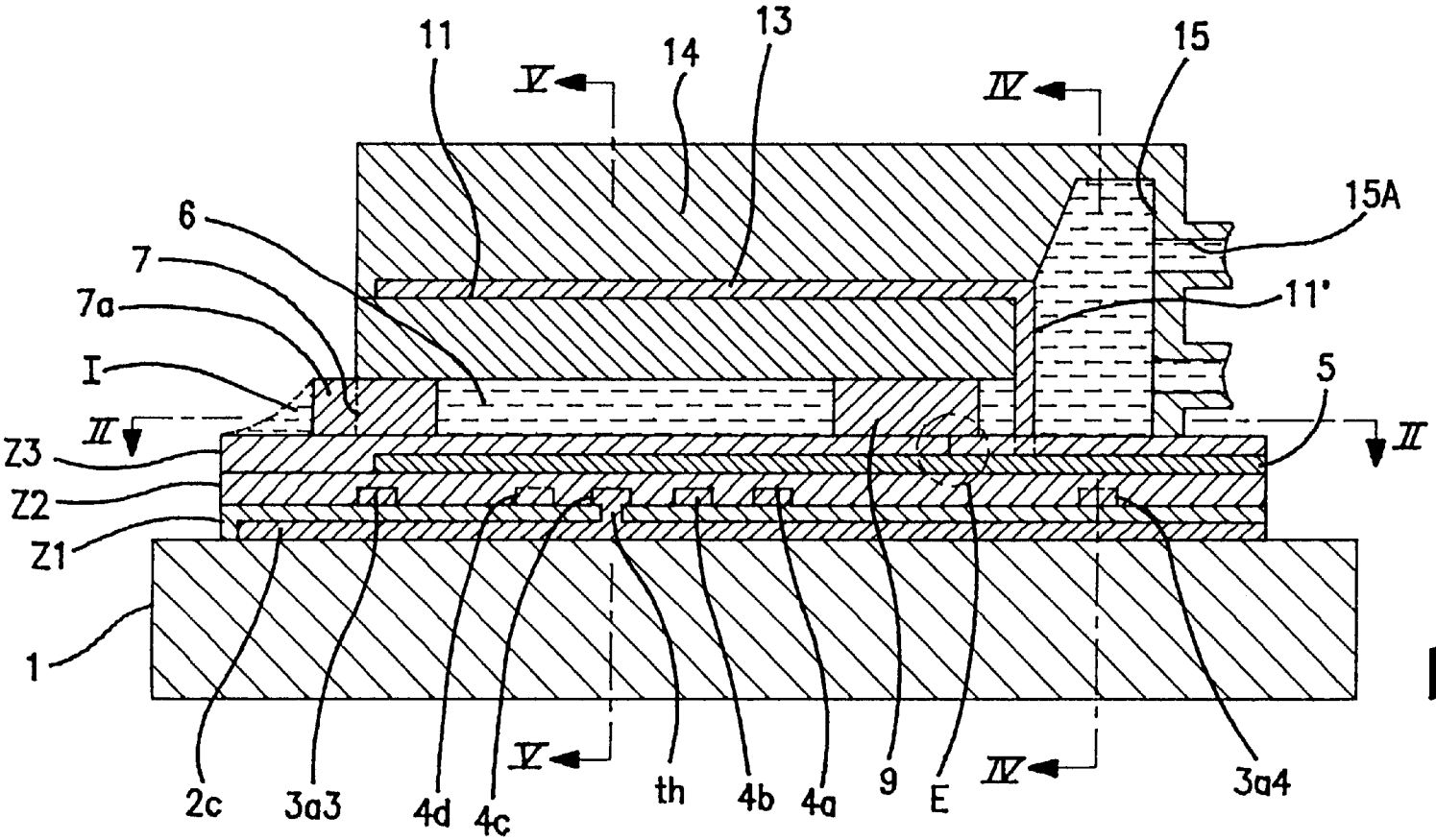
FIG. 3 shows a vertical cross section along line A—A in FIG. 2.

FIGS. 2 and 3 illustrate an ink-jet recording head 100, and FIG. 2 shows a cross section along line D—D in FIG. 3., and FIG. 3, a cross section along line A—A in FIG. 2. In FIG. 2, the illustration of a first electrophoretic electrode 5, a second electrophoretic electrode 11, a supporting member 13 and a covering member 14 shown in FIG. 3 is dispensed with.

In FIGS. 2 and 3, the electrostatic ink-jet recording head 100 comprises a substrate 1; an ink path 6 formed over the substrate 1 with insulating layers Z1, Z2 and Z3 and wiring layers therebetween, to be elaborated upon below; path diaphragms 7 and ink ejecting holes 8 forming ink ejecting portions; the cover 14; and an ink chamber 15 formed within the cover 14 and connected to the ink path 6.

Figure 4:
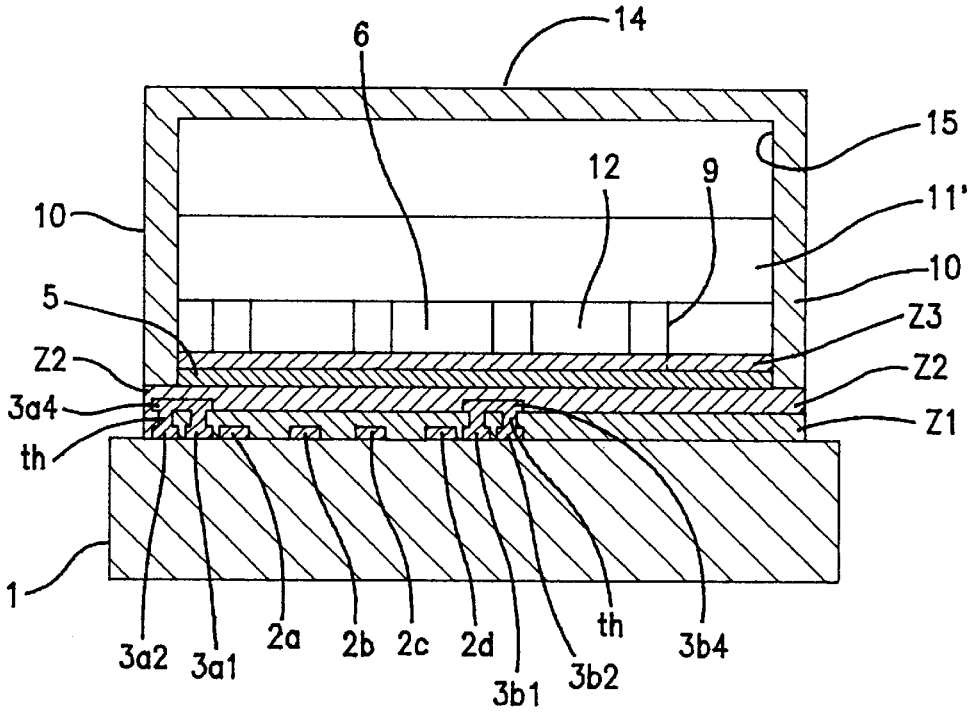
FIG. 4 shows a vertical cross section along line B—B in FIG. 3.
Figure 5:
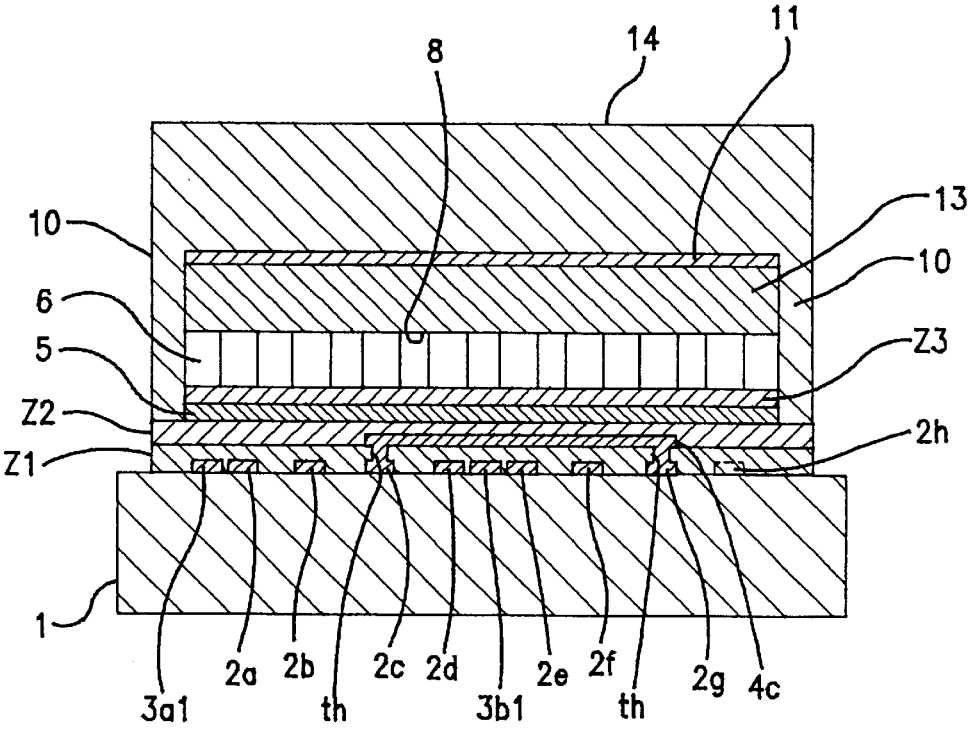
FIG. 5 shows a vertical cross section along line C—C in FIG. 3.

On the substrate 1 (base substrate) are formed a plurality of ejecting electrodes 2*a* through 2*h* in parallel to the direction of ink ejection. The substrate 1, which is an insulator formed of silicon (Si), may as well be formed of glass instead of silicon. The ejecting electrodes 2*a* through 2*h* are formed of an electroconductive material, such as chrome, sputtered all over the surface of the substrate 1 in a belt-like pattern by photo lithography. Each interval between the ejecting electrodes 2*a* through 2*h* is 300 dpi pitch or about 85 um. As shown in FIGS. 4 and 5, the ejecting electrodes 2*a* through 2*h* are arranged at fixed intervals.

As illustrated in FIG. 2, the ink ejecting tips of the ejecting electrodes 2*a* through 2*h* are acutely pointed. Thus, at each tip is formed an acutely projecting portion. The other ends of the ejecting electrodes 2*a* through 2*d* pass underneath the ink chamber 15. On the surface of the substrate 1 are formed, in addition to the ejecting electrodes 2*a* through 2*h*, electrode lines 3*a*1, 3*a*2, 3*b*1 and 3*b*2, which are parts of ejection control electrodes 3*a* and 3*b*, in parallel to the ejecting electrodes 2*a* through 3*h*. The electrode lines 3*a*1 and 3*a*2 are formed adjacent to the ejecting electrode 2*a*, and the electrode lines 3*b*1 and 3*b*2, adjacent to the ejecting electrode 2*d*.

The ejecting electrodes 2*a* through 2*h* are divided into group L and group U. The electrode lines 3*a*1 and 3*a*2 of the ejection control electrode 3*a* are driven to control the ejection of ink by the ejecting electrodes 2*a* through 2*d* of the group L, while the electrode lines 3*b*1 and 3*b*2 of the ejection control electrode 3*b* are driven to control the ejection of ink by the ejecting electrodes 2*e* through 2*h* of the group U. The ejecting electrodes 2*a* through 2*h* and the ejection control electrodes 3*a* and 3*b* are not directly connected to each other.

The ejecting electrodes 2*a* through 2*h* and the electrode lines 3*a*1, 3*a*2, 3*b*1 and 3*b*2 of the ejection control electrodes constitute a first wiring layer, which is covered by the first insulating layer Z1 as shown in FIGS. 2, 4, and 5. Over this first insulating layer Z1 is provided a second wiring layer. This second wiring layer has electrode lines 3*a*3, 3*a*4, 3*b*3 and 3*b*4 of the ejection control electrodes 3*a* and 3*b*, and they are formed in a direction orthogonal to the ejecting electrodes 2*a* through 2*h* of the first wiring layer.

The electrode lines 3*a*3 and 3*b*3 of the second wiring layer are formed over the first insulating layer Z1 in a position behind the pointed portions of the ejecting electrodes 2*a* and 2*b* of the first wiring layer. The electrode lines 3*a*3 and 3*b*3 are connected to the electrode lines 3*a*1 and 3*a*2, 3*b*1 and 3*b*2 of the ejection control electrodes 3*a* and 3*b* of the first wiring layer through a plurality of throughholes the provided in the first insulating layer Z1. Meanwhile, the short electrode line 3*a*4 of the second wiring layer connects the electrode lines 3*a*1 and 3*a*2 through a throughhole the and the short electrode line 3*b*4 connects the electrode lines 3*b*1 and 3*b*2 through another throughhole th.

This arrangement results in the formation of the two ejection control electrodes 3*a* and 3*b* each in an L shape.

The second wiring layer has four belt-like short-circuiting members 4*a* through 4*d* in addition to the electrode lines 3*a*3, 3*a*4, 3*b*3 and 3*b*4. The four belt-like short-circuiting members 4*a* through 4*d* short-circuit the ejecting electrodes 2*a* through 2*d* of group L and the ejecting electrodes 2*e* through 2*h* of group U in one-to-one correspondence. The short-circuiting members 4*a* through 4*d* are arranged in an orthogonal direction to the ejecting electrodes 2*a* through 2*h* atop the first insulating layer Z1 Thus, the ejecting electrodes 2*a* and 2*e*, the ejecting electrodes 2*b* and 2*f*, the ejecting electrodes 2*c* and 2*g*, and the ejecting electrodes 2*d* and 2*h* are short-circuited to each other through a throughhole th.

Over the second wiring layer is formed the second insulating layer Z2 all over, and a first electrophoretic electrode 5 is formed substantially all over the second insulating layer Z2. This first electrophoretic electrode 5 is formed by photo lithography, and its ejecting tip portion is positioned, as illustrated in FIG. 3, somewhat behind the tips of the ejecting electrode 2*c* (and other ejecting electrodes) and of the electrode line 3*a*3 (3*b*3) of the ejection control electrode. The width of the first electrophoretic electrode 5 is somewhat smaller than that of the second insulating layer Z2 as shown in FIGS. 4 and 5, and matches the width of the ink path 6 shown in FIGS. 2 and 3. At the two ends of the second insulating layer Z2 where the first electrophoretic electrode 5 is not formed, there stand side walls 10 of the covering member 14 to partition the ink path 6. All over the first electrophoretic electrode 5 is formed the third insulating layer Z3. In practice, a second electrophoretic electrode 11 is formed on the surface of the supporting member 13 by such a method as photo selective plating (PSP), additive photo etching (APE) or Mold-n-Plate, and the first electrophoretic electrode 5 is formed on the surface of the second insulating layer Z2 by the same method.

The ink path 6 is formed over the third insulating layer Z3. At the tip of the ink path 6 in the ink ejecting direction are formed the plurality of path diaphragms 7. The plurality of path diaphragms 7 are arranged at prescribed intervals along the electrode lines 3*a*3 and 3*b*3 of the ejection control electrodes 3*a* and 3*b* as shown in FIG. 2, and superposed over the ejecting electrodes 2*a* through 2*h* atop the insulating layers Z1 through Z3 as shown in FIG. 3. The plane of these path diaphragms 7 is shaped like a baseball home plate, and each of them has an actuely pointed portion 7*a* projecting out of the covering member 14 at an acute angle (less than 90°). These acutely pointed portions 7*a* are positioned behind the acutely pointed portions at the tips of the ejecting electrodes 2*a* through 2*h*, and are superposed over them atop the insulating layers Z1 through Z3 as shown in FIG. 3. Between the plurality of path diaphragms 7 are formed ink ejecting holes 8 (FIG. 2). Capillarity is observed in the ink ejecting holes 8. Opposite to the the path diaphragms 7 with the ink ejecting holes 8 and the ink path 6 in-between, there are arranged another plurality of path diaphragms 9 at prescribed intervals. A plurality of ink feed holes 12 (FIG. 4) connected to the ink chamber 15 by the path diaphragms 9 are arranged. These path diaphragms 7 and 9 are formed, all in the same prescribed thickness, by subjecting photosensitive high molecular films laminated on the insulating layer Z3 to photo lithography.

Above the ink path 6 is fixed the supporting member 13 consisting of insulating material, and the second and third electrophoretic electrodes 11 and 11' are provided on an upper face and an ink feed side wall 13*b* (FIG. 2) of the supporting member 13. The second electrophoretic electrode 11, as shown in FIG. 3, is positioned facing the first electrophoretic electrode 5. The third electrophoretic electrode 11' is formed at the interface between the ink path 6 and the ink chamber 15. Part of the third electrophoretic electrode 11' passes through into the third insulating layer Z3 and is short-circuited to the first electrophoretic electrode 5. As indicated by E in FIG. 3, part of the third electrophoretic electrode 11' enters into the ink path 6. Therefore, ink in the ink path 6 keeps the same electric potential as those of the first, second and third electrophoretic electrodes 5, 11 and 11'. The supporting member 13 constitutes the top plate of the ink path 6, with the path diaphragms 7 and 9 serving as pillars. The ink ejecting end face of the supporting member 13 is positioned at the root of the acutely pointed portions 7*a* of the path diaphragms 7. Therefore, the acutely pointed portions 7*a* project out of the supporting member 13 in the ink ejecting direction.

The covering member 14, consisting of insulating material, is fixed over the second electrophoretic electrode 11. The covering member 14 is provided with an insulating portion for insulating the upper face of the second electrophoretic electrode 11, the ink chamber 15 and the side walls 10 of the ink path 6, all integrated into a solid body. The ink chamber 15 of the covering member 14 has two holes 15A for ink circulation, and is connected to an external ink tank by a tube (not shown). This arrangement constantly applies a negative pressure of about 1 cm $H_2O$ to ink in the ink chamber 15 to forcibly circulate the ink.

The ink fed to the ink chamber 15 consists of thermoplastic particles, colored together with electrification controlling agent, i.e. electrified toner, dispersed in petroleum-based organic solvent (iso-paraffin). The electrified toner is apparently electrified in a positive polarity with a Zeta potential.

Figure 6:
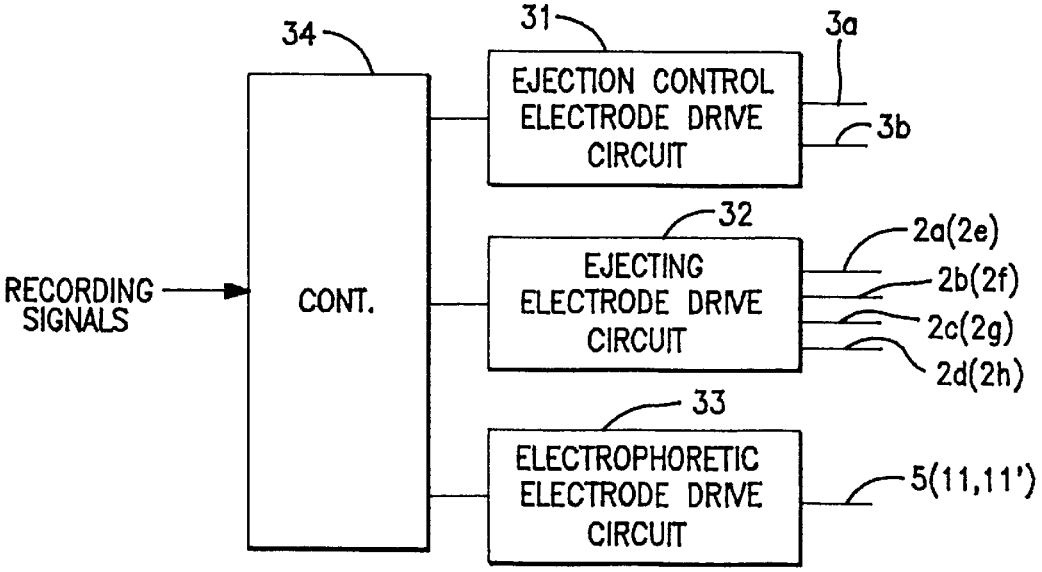
FIG. 6 is a block diagram illustrating the drive unit of the electrostatic ink-jet recording head of FIG. 2.

Here, the ejecting electrodes 2*a* through 2*h*, the ejection control electrodes 3*a* and 3*b*, and the first and second electrophoretic electrodes 5 and 11 are connected to an external voltage drive circuit assembly and set to prescribed potentials. As illustrated in FIG. 6, the voltage drive circuit assembly consists of an ejection control electrode drive circuit 31 for driving the ejection control electrodes 3*a* and 3*b*, an ejecting electrode drive circuit 32 for driving the ejecting electrodes 2*a* through 2*d* of group L or the ejecting electrodes 2*e* through 2*h* of group U, an electrophoretic electrode drive circuit 33 for driving the electrophoretic electrodes 5 and 11, and a control circuit 34. The control circuit 34 controls the drive circuits 31 through 33 in accordance with recording signals. The ejection control electrode drive circuit 31 supplies the ejection control electrode 3*a* or 3*b* with a voltage 0 (V) for inhibiting the ejection of ink and a voltage 300 (V) for ejecting ink. The ejecting electrode drive circuit 32 supplies 300 (V) to the ejecting electrodes 2*a* to 2*h* for ink ejection. The electrophoretic electrode drive circuit 33 supplies 1000 (V) to the electrophoretic electrodes 5 and 11.

Next will be described the overall operation of this embodiment.

First, ink containing electrified toner is circulated into the ink chamber 15 and, at the same time, ink penetrates into the ink path 6. When a positive voltage of 1000 (V) is applied by the electrophoretic electrode drive circuit 33 of FIG. 6 to the first through third electrophoretic electrodes 5, 11 and 11', electrostatic force (repulsive force) generates between the electrified toner of positive polarity in the ink and the electrophoretic electrodes 5, 11 and 11'. Because the electrophoretic electrode 11' is formed on the ink chamber 15 side, the electrified toner in the ink path 6 shifts toward the plurality of ink ejecting holes 8. Then, as shown in FIGS. 2 and 3, at each ink ejecting hole 8, an ink meniscus I is formed at the acutely pointed portion 7*a* of the path diaphragms 7 by the surface tension of ink.

The vertical cross section of this ink meniscus I, as illustrated in FIG. 3, is shaped in a triangle having one concave side, because the tips of the first and second electrophoretic electrodes 5 and 11 are positioned toward the ink chamber, somewhat behind the acutely pointed portions 7*a* of the path diaphragms 7. The potential of ink, which comes into contact with the third electrophoretic electrode 11' in the ink chamber 15 as shown in FIG. 3, is 1000 (V).

Then, in accordance with the recording signals, the control circuit 34 selects, out of the ejecting electrodes 2*a* through 2*h*, one which is to eject ink. This sets the voltages of the ejection control electrodes for the group of ejecting electrodes not including the selected one to a low level (0 (V)). If, for instance, the ejecting electrode 2*b* is selected, the ejection control electrode 3*b* corresponding to the ejecting electrodes of group U, not including this ejecting electrode 2*b*, is set to the low level (0 (V)). This causes the positively electrified toner, having formed ink meniscuses at the tips of the plurality of path diaphragms of group U, to be somewhat pulled back within the ink path 6 by the electrostatic attraction having generated between the toner and the ejection control electrode 3*b* of 0 (V).

Next, the control circuit 34 controls the ejecting electrode drive circuit 32 so as to drive the ejecting electrode 2*b*, and applies a voltage of 300 (V) to the ejection control electrode 3*a*. This causes the voltage of the ejecting electrode 2*b* to be set to 300 (V), and a strong electric field generates between the ejecting electrode 2*b* and the opposite electrode 20 of FIG. 1. Then, the electric toner having formed the ink meniscus I gathers at the pointed tip of the ejecting electrode 2*b*, and flies toward the opposite electrode 20 as a toner cluster. As a result, ink sticks to recording paper P arranged between the recording head 100 and the opposite electrode 20 of FIG. 1 to form an image.

Figure 7A:
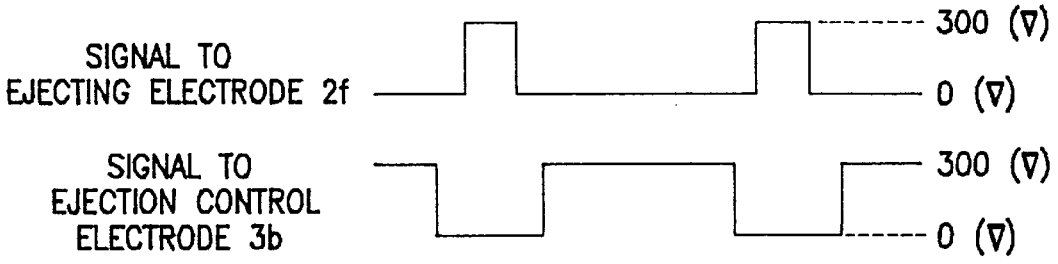
FIGS. 7A and 7B are timing charts showing the variations over time of the drive pulse fed to the ejecting electrodes and the ejection control electrode, the former illustrating a case in which ink ejection is inhibited and the latter, a case in which ink is ejected.
Figure 7B:
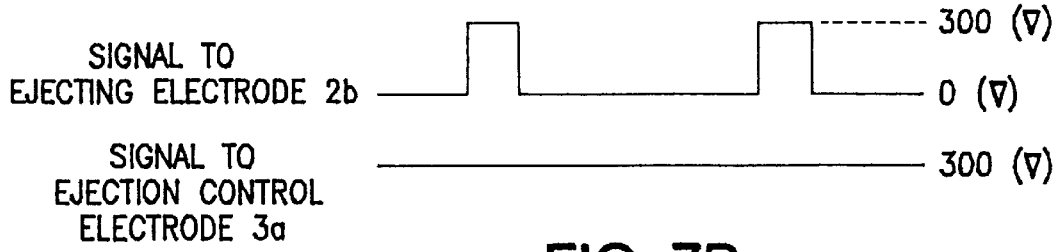

The ejecting electrode 2*b* and the ejecting electrode 2*f* of group U are short-circuited to each other as shown in FIG. 2, and a voltage of 300 (V) is applied to the two electrodes 2*b* and 2*f*. FIG. 7A is a timing chart of an ejecting electrode drive signal supplied to the ejecting electrode 2*f* from which toner ejection is inhibited, and an ejection control electrode drive signal supplied to the corresponding ejection control electrode 3*b*. FIG. 7B is a timing chart of an ejecting electrode drive signal supplied to the ejecting electrode 2*b* from which toner is ejected and an ejection control electrode drive signal supplied to the corresponding ejection control electrode 3*a*. In this case, the ejecting electrodes 2*b* and 2*f* are set to a high level (300 (V)), and the voltage applied to the ejecting electrode 3*b* is subsequently returned to the initial potential 0 (V), but the potential of the ejection control electrode 3*a* remains at 300 (V). Since the ink meniscus I is considerably closer to the ejection control electrode 3*b* than to the opposite electrode 20, the electrified toner in the ink meniscus I is attracted to the ejection control electrode 3*b*, and no toner flies from the ejecting electrode 2*f*.

The toner flown to the recording paper by the above-described ink ejecting operation is later heated by a heater to become fixed (not shown).

The shortage of electrified toner in the vicinity of the ink ejecting holes 8 occurs after its ejection. In this case, toner is fed from the ink path 6 for making up for the shortage.

More specifically, electrified toner in the ink path 6 is electrophoresed from the ink chamber side to the ink ejecting holes 8 by the action of an electric field emitted from the electrophoretic electrodes 5 and 11 toward the ink ejecting side, and supplied to the ink meniscus I. Then, appropriate ejecting electrodes are selected one after another to let the above-described flying take place consecutively.

Hereupon, after the ejection of positively electrified toner, ink in the vicinities of the ejecting electrodes is filled with counter ions of negative polarity. These counter ions disturb the electric field formed between the electrophoretic electrodes 5 and 11 on the one hand and the ejecting electrodes on the other, and thereby makes it impossible to sufficiently supply toner by electrophoresis. In this embodiment of the invention, since the third electrophoretic electrode 11' is exposed to the ink chamber 15 and the ink path 6 to be directly short-circuited to ink, the surplus counter ions which would otherwise invite the aforementioned trouble are forcibly discharged and removed.

As described so far, since the ejecting electrodes 2*a* through 2*h* for ejecting electrified toner and the ejection control electrodes 3*a* and 3*b* are formed in layers one over another in the electrostatic ink-jet recording head 100 with the insulating layers Z1 and Z2 in-between, the overall size of the recording head can be reduced.

Furthermore, as the electrophoretic electrodes have first and second electrophoretic electrodes 5 and 11 sandwiching the ink path via and the third electrophoretic electrode 11' formed on the interface between the ink chamber 15 and the ink path 6, and voltages of the same polarity as that of said electrified toner are supplied to these electrophoretic electrode faces, the electrified toner can be reliably electrophoresed from the ink path to the ink ejecting portions (comprising the path diaphragms 7 and the ink ejecting holes 8). Therefore, unlike in the configuration according to the prior art, there is no need to arrange a porous body within the ink path. With respect to feeding operation for feeding electrified toner from the ink chamber side to the ink ejecting portions side, since the electrified toner can be supplied without contact, toner supply can be much faster than in the conventional recording head using a porous body, resulting in high-speed and high-quality printing.

Furthermore, as the electrophoretic electrodes 5, 11 and 11' can be formed with relative ease by such a method as photo lithography, PSP, APE or Mold-n-Plate, the manufacturing cost can be simplified and the manufacturing complexity reduced in comparison with the conventional configuration having a porous body arranged within the ink path.

In addition, as the ejecting electrodes 2*a* through 2*h* are arranged in a belt-like form from the ink chamber 15 to the ink ejecting portions, the ejecting electrodes can be formed in high density, contributing to improving the print resolution and reducing the size of the recording head.

At the same time, the ejection control electrodes 3*a* and 3*b* are formed near the ink ejection holes 8 in a direction orthogonal to the plurality of ejecting electrodes 2*a* through 2*h*, and divide the ejecting electrodes 2*a* to 2*h* into two groups U and L for the group control purpose. Therefore, the number of ejection control electrodes can be reduced, and this enables the size of the recording head to be compressed. As the number of ejection control electrodes can be much smaller than that of ejecting electrodes, there is the further benefit of simplifying the configuration of the drive unit for the recording head.

Moreover, as matching ejecting electrodes in the respective groups (L and U) are short-circuited by short-circuiting members 4*a* through 4*d* and the ejecting electrodes of one group are driven with the driving of the ejection control electrode, the volume of wiring for the ejection electrodes needed for connection to the ejecting electrode drive circuit in the external drive unit illustrated in FIG. 6 can be halved. This results in the prevention of troubles including faulty connection between this recording head and an external drive unit and corresponding improvement in the reliability of ejecting operation. Even if the number of groups of ejecting electrodes is increased to three or more, the number of contacts of ejecting electrodes to be connected to an external drive unit will be kept unchanged by the short-circuiting of matching ejecting electrodes in the respective groups, but only the number of ejection control electrodes will increase according to the number of extra groups of ejecting electrodes. As a result, there is the additional benefit of facilitating flexible redesigning according to the configuration of the desired recording system.

Furthermore, the ink ejecting portions consist of a plurality of path diaphragms 7 arranged in parallel to the ejection control electrodes formed at the tip of the ink path 6 and a plurality of ink ejection holes 8 formed between the path diaphragms 7 and connected to the ink path 6. The path diaphragms 7 are superposed atop the third insulating layer Z3 over the tips of the ejecting electrodes 2*a* through 2*h*. This enables the ejecting electrodes 2*a* through 2*h* to effect an electric field on electrified toner in the ink especially with the path diaphragms 7. On the other hand, at the tips of the ejecting electrodes 2*a* to 2*h* and the path diaphragms 7 are formed acutely pointed portions, and the acutely pointed portions of the ejecting electrodes project more toward the tip than those of the path diaphragms. This arrangement enables the ink meniscus I to be formed at the tip of each ejecting electrode, as illustrated in FIGS. 2 and 3, to ensure smooth ink ejection. Moreover, the formation of these ink meniscuses I can prevent the drops of ink from becoming uneven.

Although the electrodes in the electrostatic inkjet recording head 100 of FIG. 1 are stacked over the substrate 1 with insulating layers in-between in the order of the ejecting electrodes 2*a* through 2*h*, the ejection control electrodes 3*a* and 3*b*, and the electrophoretic electrodes 5, 11 and 11', the order of stacking the electrodes is not limited to this. The first electrophoretic electrode 5 and the second electrophoretic electrode 11 may as well be arranged beside, instead of over or underneath, the ink path. The short-circuiting members 4*a* through 4*d* for ejecting electrodes shown in FIG. 2 need not be arranged orthogonal to the ejecting electrodes. The number of groups of ejecting electrodes may be more than two.

Where the potential of the opposite electrode 20 is V1; the voltage supplied to the electrophoretic electrodes 5, 11 and 11' is V2; the drive voltage for the ejecting electrodes 2*a* through 2*h* when ink is to be ejected is V3; the voltage supplied to the ejection control electrodes 3*a* and 3*b* is V4; and the voltage supplied to the ejection control electrodes 3*a* and 3*b* when no ink is to be ejected is V4':

(i) V2>(V3, V4)>V1 if positively electrified toner is used, or (ii) V2<(V3, V4)<V1 if negatively electrified toner is used.

The voltage V4' is needed, when ink ejection is to be inhibited, for keeping the ink in the ink meniscuses I of FIGS. 2 and 3, and should desirably be either exactly or approximately equal to the potential V1 of the opposite electrode 20.

What is claimed is:

1. An electrostatic ink-jet recording device using ink containing electrified toner, comprising:

an ink path for said ink;

ink ejecting portions separated from each other at one end of said ink path;

an electrophoretic electrode which contacts said ink path and shifts the electrified toner in said ink path to said ink ejecting portions by electrostatic repulsive force;

a plurality of ejecting electrodes along said ink path forming a first electric field providing an ejecting force to the electrified toner deposited in said ink path;

ejection control electrodes forming a second electric field preventing the electrified toner from being ejected from said ejecting portions even when said first electric field is being generated.

2. The electrostatic ink-jet recording head, as claimed in claim 1, wherein said electrophoretic electrode is supplied with a voltage of a same polarity as a polarity of the electrified toner.

3. The electrostatic ink-jet recording head, as claimed in claim 2, wherein said electrophoretic electrode is a first electrophoretic electrode, said recording head further comprising a second electrophoretic electrode that is on an opposite side of said ink path from said first electrophoretic electrode, and a third electrophoretic electrode that contacts said ink path.

4. The electrostatic ink-jet recording head, as claimed in claim 2, wherein said ejecting electrodes are arranged linearly in parallel to each other along a direction of movement of the electrified toner in said ink path.

5. The electrostatic ink-jet recording head, as claimed in claim 4, wherein said ejection control electrodes are arranged near said ink ejecting portions and orthogonal to said plurality of ejecting electrodes.

6. The electrostatic ink-jet recording head, as claimed in claim 5, wherein said ink ejecting portions comprise a plurality of path diaphragms at said one end of said ink path and arranged in parallel to said ejection control electrodes, and a plurality of ink ejecting holes between said path diaphragms and connected to said ink path.

7. The electrostatic ink-jet recording head, as claimed in claim 6, wherein said path diaphragms are superposed over said ejecting electrodes.

8. The electrostatic ink-jet recording head, as claimed in claim 7, wherein acutely pointed portions are formed at tips of said ejecting electrodes and at tips of said path diaphragms, and the acutely pointed portions of said ejecting electrodes project forwardly from said path diaphragms.

9. The electrostatic ink-jet recording head, as claimed in claim 5, wherein at least two groups, each having a plurality of said ejecting electrodes and one of said ejection control electrodes, are arranged in parallel, and corresponding ones of said ejecting electrodes in these respective groups are connected by an electroconductive short-circuiting members.

10. The electrostatic ink-jet recording head, as claimed in claim 1, wherein said ejecting electrodes are on a substrate, a first insulating layer is over said ejecting electrodes, said ejection control electrodes are on said first insulating layer in a position over said ejecting electrodes, a second insulating layer is on said ejection control electrodes, and said ink ejecting portions are on said second insulating layer.

11. The electrostatic ink-jet recording head, as claimed in claim 10, wherein said electrophoretic electrode comprises first and second electrophoretic electrodes sandwiching said ink path and a third electrophoretic electrode formed at an interface between said ink chamber and said ink path, and each of said electrophoretic electrodes is supplied with a voltage of a polarity the same as a polarity of the electrified toner.

12. The electrostatic ink-jet recording head, as claimed in claim 11, wherein said first electrophoretic electrode is formed on said second insulating layer, and said ink path is on a third insulating layer that overlies said first electrophoretic electrode.

13. The electrostatic ink-jet recording head, as claimed in claim 1, wherein said ejection control electrodes are on a substrate, a first insulating layer is on said ejection control electrodes, said ejecting electrodes are on said first insulating layer in a position over said ejection control electrodes, a second insulating layer is on said ejecting electrodes, and said ink ejecting portions are over said second insulating layer and superposed over said ejecting electrodes and said ejection control electrodes.

14. The device of claim 1, further comprising a first driving circuit driving said ejecting electrodes forming said first electric field, a second driving circuit selectively driving said ejection control electrodes forming said second electric field, and a third driving circuit driving said electrophoretic electrode.

15. An electrostatic ink-jet recording head comprising:

plural ink ejecting nozzles at one end of an ink path;

an electrophoretic electrode contacting said path and compelling ink along said path to said nozzles;

plural ejecting electrodes, each adjacent one of said nozzles and ejecting ink from respective said nozzles;

an ejection control electrode adjacent a group of said plural nozzles and preventing ejection of ink from said group of nozzles; and drive circuitry that applies a first electric field to said ejecting electrodes, selectively applies a second electric field to said ejection control electrodes, and drives said electrophoretic electrode, wherein said second electric field prevents ejection of ink from said group of nozzles even when said first electric field is being generated.

16. The recording head of claim 15, wherein said ejection control electrode comprises a portion orthogonal to said nozzles in said group of nozzles.

17. The recording head of claim 16, comprising two of said group of nozzles, and one said ejection control electrode for each of said two groups.

18. The recording head of claim 17, further comprising respective short-circuit connections between ones of said ejecting electrodes adjacent said nozzles in a first said group and corresponding ones of said ejecting electrodes adjacent said nozzles in a second said group.

19. The recording head of claim 15, wherein said electrophoretic electrode is a first electrophoretic electrode adjacent one side of said path and further comprising a second electrophoretic electrode adjacent a second side of said path and a third electrophoretic electrode contacting in contact with said path, said three electrophoretic electrodes being electrically connected.

20. The recording head of claim 15, wherein each of said plural ink ejecting nozzles comprise a pointed tip, and each of said plural ejecting electrodes comprise a pointed tip, and wherein said pointed tips of said ejecting electrodes extend beyond said pointed tips of said nozzles at said one end.

* * * * *